US007383822B2

(12) United States Patent
Ramamurthy et al.

(10) Patent No.: US 7,383,822 B2
(45) Date of Patent: Jun. 10, 2008

(54) FUEL PUMP MODULE FOR ELECTRONIC RETURNLESS FUEL SYSTEM

(75) Inventors: Dhyana Ramamurthy, Novi, MI (US); Kingo Okada, W. Bloomfield, MI (US); Hideto Takahashi, Kariya (JP)

(73) Assignees: DENSO International America, Inc., Southfield, MI (US); DENSO Corporation, Kariya (JP)

( * ) Notice: Subject to any disclaimer, the term of this patent is extended or adjusted under 35 U.S.C. 154(b) by 0 days.

(21) Appl. No.: 11/507,314

(22) Filed: Aug. 21, 2006

(65) Prior Publication Data

US 2008/0041345 A1 Feb. 21, 2008

(51) Int. Cl.
*F02M 37/04* (2006.01)

(52) U.S. Cl. ..... 123/509; 123/495; 123/514; 123/510

(58) Field of Classification Search ..... 123/495, 123/509, 514, 510
See application file for complete search history.

(56) References Cited

U.S. PATENT DOCUMENTS 5,477,829 A 12/1995 Hassinger et al.
5,593,287 A * 1/1997 Sadakata et al. ..... 417/366
5,819,709 A 10/1998 Holmes et al.
6,532,941 B2 3/2003 Begley et al.
6,622,707 B2 9/2003 Begley et al.
6,854,451 B2 * 2/2005 Ebihara et al. ..... 123/509
6,966,306 B2 * 11/2005 Sawert et al. ..... 123/509
7,066,152 B2 * 6/2006 Stroia et al. ..... 123/467

* cited by examiner

*Primary Examiner*—Stephen K. Cronin
*Assistant Examiner*—J. Page Hufty
(74) *Attorney, Agent, or Firm*—Harness, Dickey & Pierce, PLC

(57) ABSTRACT

A fuel pump module has a fuel pump with an outlet located within a fuel reservoir, a fuel filter casing within which a fuel filter receives fuel from the fuel pump fuel outlet. A fuel discharge housing attaches to the fuel filter casing such that fuel passing from the filter and into the discharge casing then discharges from either a casing fuel outlet or a bleed orifice. The casing fuel outlet leads to the engine while the bleed orifice discharges fuel into a sump formed into the reservoir's bottom wall under the bleed orifice. The sump retains a quantity of fuel so that during low fuel levels within the reservoir, when the engine is off, the fuel filter maintains its prime condition from fuel in the sump to lessen the filter prime time during engine starting. Selective placement of fuel valves also decreases fuel system prime times.

13 Claims, 8 Drawing Sheets

FUEL PUMP MODULE FOR ELECTRONIC RETURNLESS FUEL SYSTEM

FIELD

The present disclosure relates generally to a fuel pump module for an electronic returnless fuel system. More specifically, the disclosure relates to a structure for maintaining cooling of an electric fuel pump, for maintaining fuel filter saturation and thus prime of the fuel system, and for easing fuel pump module assembly and reducing the size of the overall fuel pump module package.

BACKGROUND

The statements in this section merely provide background information related to the present disclosure and may not constitute prior art. Conventional vehicular fuel systems, such as those installed in automobiles, may employ a "return fuel system" whereby a fuel supply tube is utilized to supply fuel to an engine and a fuel return line is utilized to return, hence "return fuel system," unused fuel to a fuel tank. More modern fuel systems typically employ a "returnless fuel system" that may either be mechanically or electronically controlled. Regarding such returnless fuel systems, such as an electronic returnless fuel system ("ERFS"), only a fuel supply line from a fuel tank to an engine is utilized; therefore, no return fuel line from the engine to the fuel tank is necessary. As a result, in an ERFS only the exact volume of fuel required by an engine is delivered to the engine, regardless of the varying degree of the volume of fuel required.

While current electronic returnless fuel systems have generally proven to be satisfactory for their applications, each is associated with its share of limitations. One limitation of current ERFS is maintaining fuel pressure in as much of the fuel line as possible in order to accomplish engine starting and restarting as quickly as possible with no interruptions of fuel supply to the engine. Another limitation of current ERFS is maintaining the prime condition of the fuel line to prevent "depriming" of the fuel line. An adequate prime condition will permit an adequate fuel supply to reach the engine during engine starting. Another limitation of ERFS is keeping the fuel filter surrounding the fuel pump sufficiently saturated with fuel when the fuel pump module reservoir is experiencing a low fuel level or volume.

In still yet another limitation pertaining to pressure valves, valve placement may not be advantageous for ease of assembly or for best utilizing space within the fuel pump module reservoir. Additionally, placement of such pressure relief and/or check valves may not be optimally advantageous for maintaining adequate fuel volumes and pressures in the fuel line. Finally, modern ERFS do not provide a structure for capturing fuel from a bleed orifice to help maintain the prime condition of the fuel pump module filter, such as the filter surrounding the fuel pump.

What is needed then is a device that does not suffer from the above limitations. This, in turn, will provide a device that provides pressure relief valves in locations that permit ease of assembly and that permits fuel to be vented into the fuel tank or fuel pump module reservoir as design dictates. Furthermore, a device will be provided that permits fuel to be pumped into a module sump to provide cooling to the fuel pump and to be used as fuel to maintain a primed condition of the fuel filter.

SUMMARY

A fuel pump module has a fuel pump module reservoir; a fuel pump located within the reservoir; a fuel pump fuel outlet, a fuel filter surrounding the fuel pump that receives fuel from a fuel pump fuel outlet, and a fuel discharge housing attached to the fuel filter. The fuel discharge housing has a fuel outlet and a fuel bleed orifice. The fuel outlet delivers fuel to the engine while the bleed flow orifice delivers fuel into a sump located on the floor of the reservoir.

The sump is a holding location for fuel when the fuel tank and fuel pump module reservoir are otherwise experiencing a low fuel situation. A nozzle and orifice on the fuel discharge housing discharges fuel to the sump, which is below the housing. The fuel in the sump is then used to keep the fuel filter around the fuel pump wet (primed) when the pump and engine are not operating. Capillary action permits transfer of the fuel from the sump into the filter, which may be made of paper. Keeping the filter primed results in lower prime times of the filter, and thus the entire fuel system, during restarting. Because the nozzle also discharges fuel when the fuel pump is operating, the fuel pump can be cooled more quickly than if the nozzle was not part of the module. That is, since the nozzle discharges fuel that is not directed to the engine for combustion, the nozzle permits the pump to discharge more fuel than it otherwise would, thus permitting the use of the extra liquid fuel for pump cooling purposes. Heat is transferred from the fuel pump to the liquid fuel passing through the pump.

The fuel pump module also has a pressure relief valve and a pressure check valve. The pressure relief valves and the pressure check valves may be located at various positions in the fuel system to achieve the desired effect. One desired effect is to position the pressure relief valve so that the fuel line pressure can be controlled and so that fuel can be discharged back into the fuel tank. Another desired effect is to position the pressure check valve such that the valve closes and preserves the fuel in the line at the operating fuel pressure required of the engine. By moving the check valve location, more fuel at operating pressure may be preserved in the line, thus reducing the length of fuel system prime times of the fuel pump upon engine restarting.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes of the teachings of the present invention only and are not intended to limit the scope of the present disclosure in any way.

DETAILED DESCRIPTION

Figure 1:
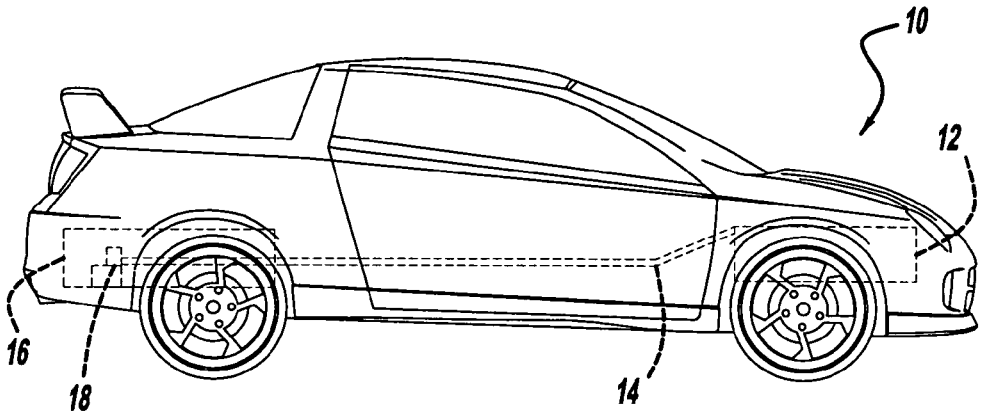
FIG. 1 is a perspective view of a vehicle depicting a fuel system in phantom.

The following description is merely exemplary in nature and is not intended to limit the present disclosure, application, or uses. It should be understood that throughout the drawings, corresponding reference numerals indicate like or corresponding parts and features. With reference to FIGS. 1-21, description of a fuel pump module for an electronic returnless fuel system ("ERFS"), will be described.

Figure 2:
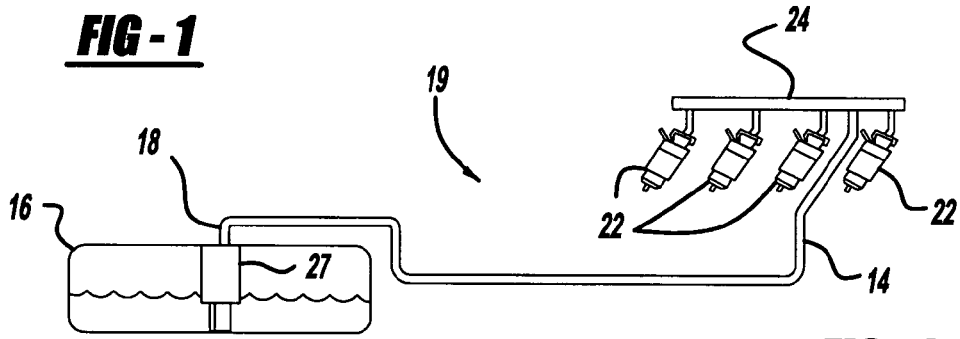
FIG. 2 is a perspective view of a vehicle fuel supply system depicting fuel injectors.

FIG. 1 depicts a vehicle such as an automobile 10 having an engine 12, a fuel supply line 14, a fuel tank 16, and a fuel pump module 18. The fuel pump module 18 fits within the fuel tank 16 and is normally submerged in or surrounded by varying amounts of liquid fuel within the fuel tank 16 when the fuel tank 16 possesses liquid fuel. A fuel pump within the fuel pump module 18 pumps fuel to the engine 12 through a fuel supply line 14. FIG. 2 is a perspective view of a vehicle fuel supply system 19 depicting fuel injectors 22. More specifically, in an ERFS, only a fuel supply line 14 carries fuel between the fuel pump module 18 and a common fuel injector rail 24. Once the fuel reaches the injector rail 24, also called a "common rail," as depicted in FIG. 2, the fuel passes into individual fuel injectors 22 before being sprayed or injected into individual combustion cylinders of the internal combustion engine 12. The fuel supply system 19 has no fuel return line from the common rail 24 to the fuel tank 16.

Figure 3:
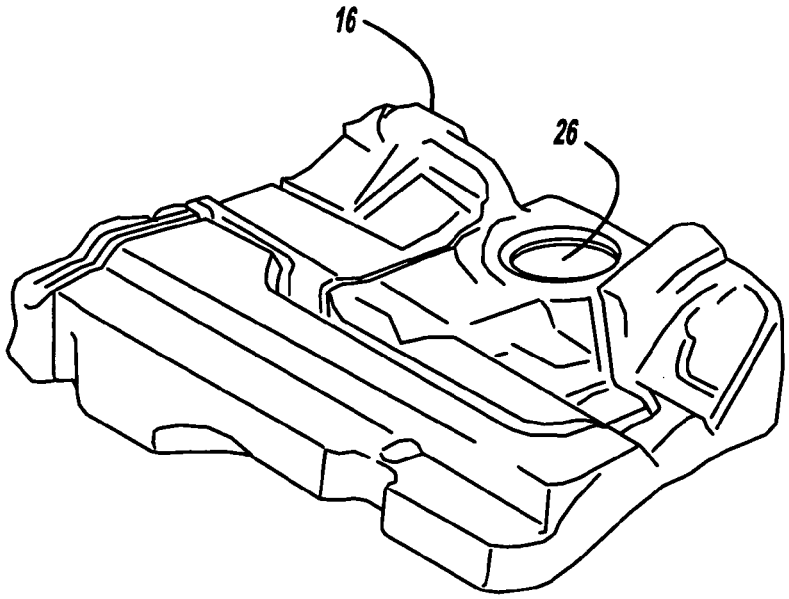
FIG. 3 is a perspective view of a vehicle fuel tank depicting the location of a fuel pump module.
Figure 4:
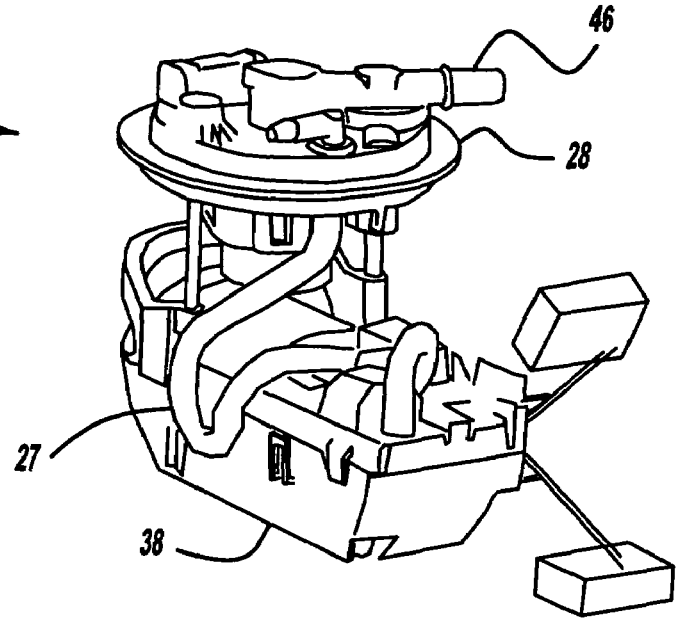
FIG. 4 is a perspective view of a fuel pump module.

FIG. 3 is a perspective view of a vehicle fuel tank 16 depicting a mounting location 26, a hole, for a fuel pump module 18. FIG. 4 depicts one embodiment of a fuel pump module 18 that may be lowered through the hole 26 of the fuel tank 16 when installed. While the fuel pump module 18 of FIG. 4 depicts a generally horizontally elongated reservoir 27, the reservoir may be designed to be more vertically cylindrical as depicted in FIG. 6, either of which is suitable for the teachings of the present invention.

Figure 5:
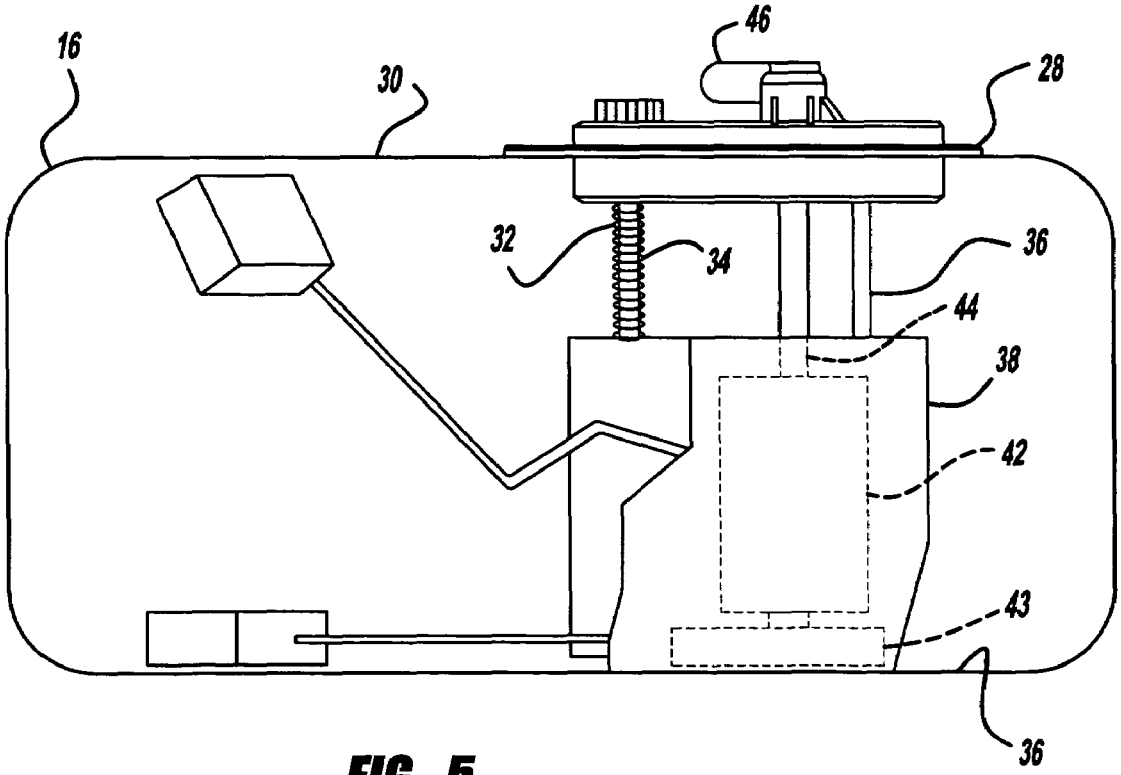
FIG. 5 is a side view of a fuel pump module in its installed position within a vehicle fuel tank.

Continuing with the fuel pump module 18 of FIGS. 4 and 5, a flange 28 rests on a top surface 30 of the fuel tank 16 when the module 18 is in its installed position. Although the flange 28 ultimately abuts the top surface 30 of the fuel tank 16 upon installation of the module 18, the flange 28 must be forced downwardly, or into the fuel tank 16, in order to sufficiently compress the spring 32, which resides around the first strut 34, to bias the spring 32 and cause the reservoir 38 to be held against the fuel tank floor 36 by the force of the spring 32. A second strut 36 assists in securing the reservoir 38, and although not depicted, a spring may be secured around the second strut 36. Upon compression of the spring 32, the flange 28 is secured to the top of the fuel tank 16 by a locking ring (not shown) or similar device. While the flange 28 creates a seal around the periphery of the hole 26, the reservoir 38 is securely held against the bottom floor of the fuel tank 16.

FIG. 5 depicts a fuel pump module 18 with a fuel pump 42 residing within the reservoir 38. The fuel pump 42 draws liquid fuel from inside the reservoir 38, through the fuel sock 43, which is a filter, and ultimately through the pump 42 itself where the fuel is discharged from an exit port 44. The fuel finally exits the fuel pump module by an exit line 46 on the top of the fuel pump module flange 28 and then into the fuel line 14. Now, a more detailed explanation of the teachings of the invention will be presented.

Figure 6:
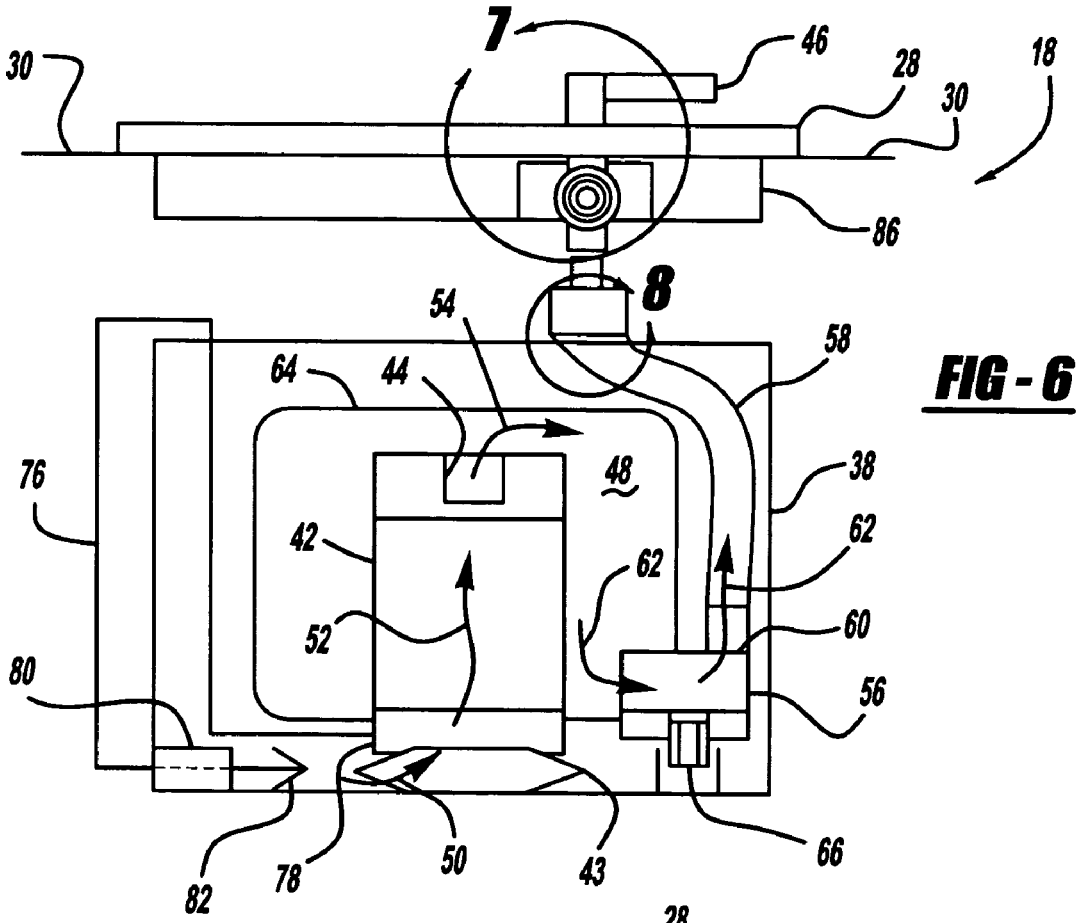
FIG. 6 is a side view of a fuel pump module depicting a bleed flow orifice and module sump.

FIG. 6 depicts a first configuration of a fuel pump module 18 according to the teachings that employs a fuel pump 42 that is surrounded by a filter 48. More specifically, fuel within the reservoir 38 is drawn through the fuel sock 43 in accordance with the arrow 50 and into the fuel pump 42. After being drawn through the fuel pump 42 in accordance with the arrow 52 and pumped from the exit orifice 44 in accordance with the arrow 54, the fuel passes into and through the filter 48 before reaching the fuel discharge housing 56, which is depicted in an enlarged view in FIG. 18. As depicted with continued reference to FIGS. 6 and 18, the fuel discharge housing 56 may be an integral part of the filter case 64. The filter case 64, within which the filter 48 resides, may be made of a rigid plastic in a molding process with the fuel discharge housing 56 being integrally molded into the filter case 64 in such process. Alternatively, the fuel discharge housing 56 may be a separate piece that is attached to the filter case 64 while employing a sealed interface, such as by utilizing an O-ring or a gasket (not shown).

Figure 18:
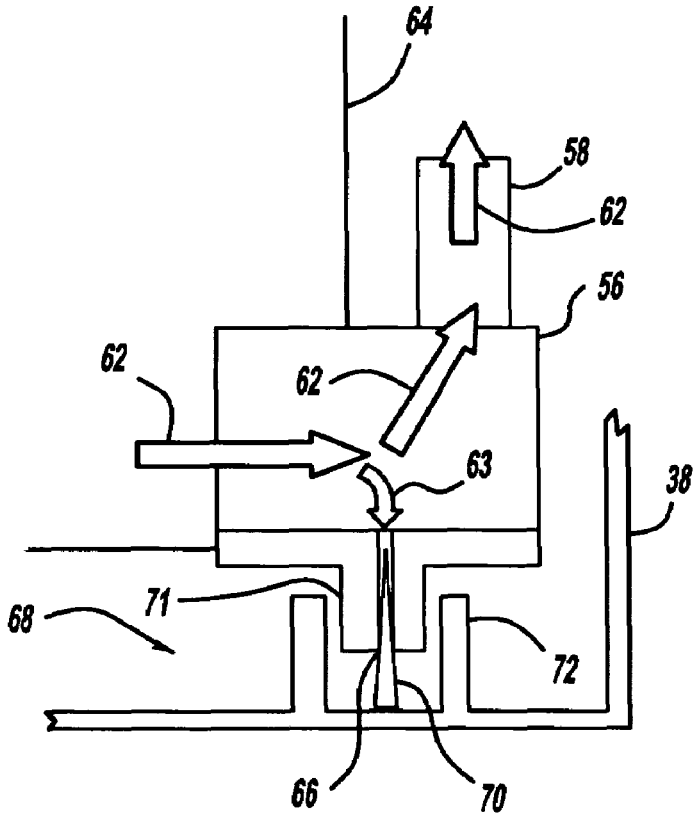
FIG. 18 is an enlarged cross-sectional view of a bleed flow orifice and sump of a fuel pump module reservoir.
Figure 19:
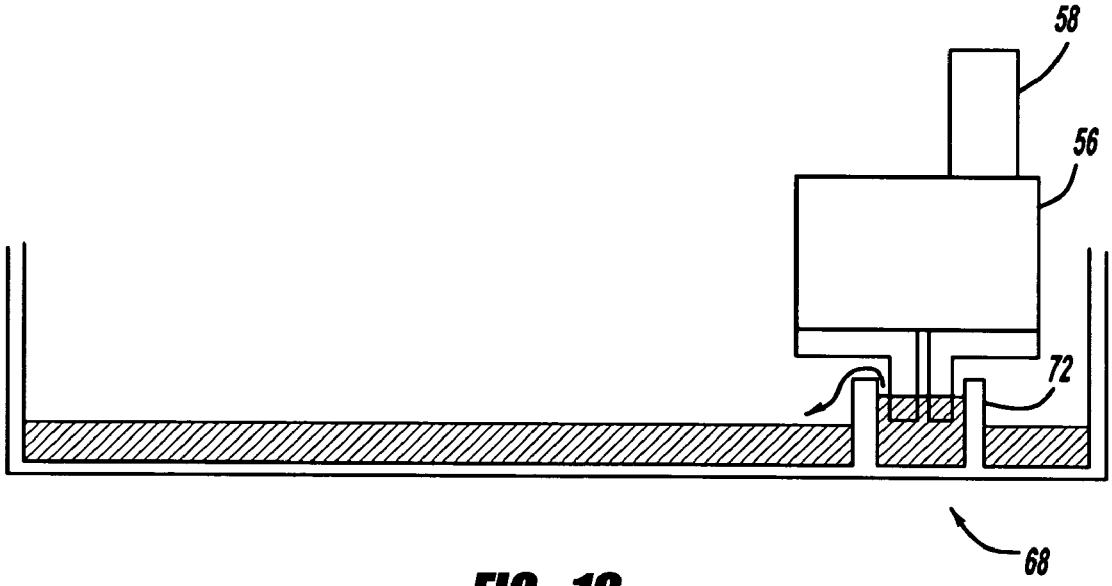
FIG. 19 is an enlarged cross-sectional view of the bleed flow orifice and sump of a fuel pump module reservoir of FIG. 18 depicting fuel levels.
Figure 20:
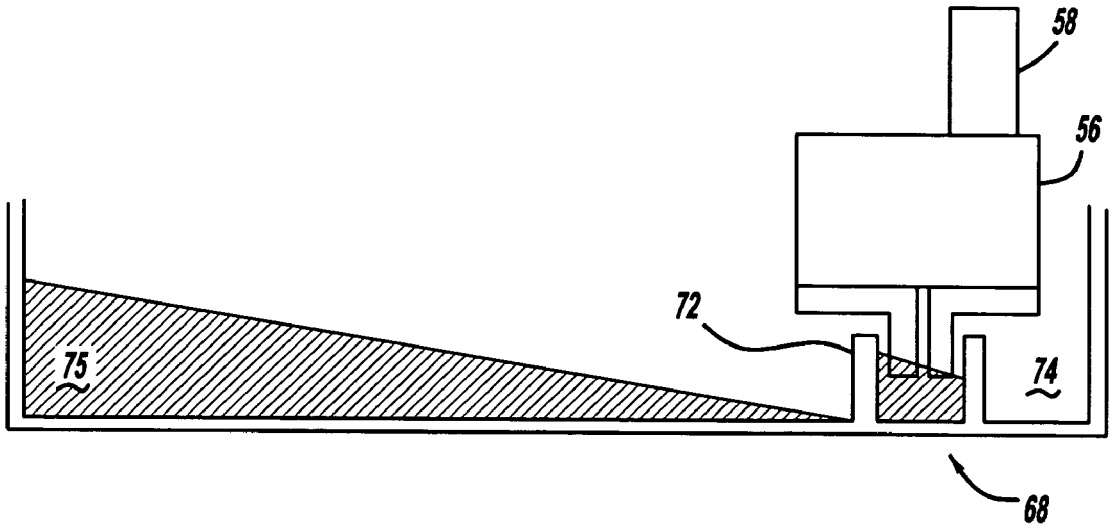
FIG. 20 is an enlarged cross-sectional view of a bleed flow orifice and sump of a fuel pump module reservoir depicting fuel levels when a vehicle is situated at an angle.

Because the filter case 64 and fuel discharge housing 56 are hollow and permit the passage of fuel between them, the fuel enters the fuel discharge housing 56 from the filter case 64 and then may pass into the discharge tube 58 via the discharge tube outlet 60 of the fuel discharge housing 56 in accordance with fuel flow arrows 62. In addition to passing into the discharge tube 58, some of the fuel passes out the bottom of the fuel discharge housing 56 via a sump orifice 66, also called a housing fuel bleed orifice. With reference to FIG. 18, the sump orifice 66 discharges fuel in accordance with arrow 63 and fuel spray 70 into a sump 68 that, in one instance, is integrally molded into the reservoir 38 just below the fuel discharge housing 56. The sump may be cylindrical, square, or other shape depending upon the volume of fuel desired to be held, or other factor, such as space available, but in any embodiment, the sump 68 will have at least one sump wall 72. As depicted in FIGS. 19 and 20, the sump 68, and more specifically sump wall(s) 72, will hold a volume of fuel, the reason for which will now be explained. For the purposes of explaining the priming of the fuel system, the "fuel system" is every component from, and including, the fuel pump 42 to the fuel injectors 22; that is, the fuel pump 42, fuel filter 48, fuel discharge housing 56, pressure check valve 92, discharge tube 58, pressure relief valve 84, exit line 46, fuel line 14, injector rail 24, and injectors 22.

FIG. 19 depicts a scenario in which a vehicle employing the sump feature of the present invention is situated, parked for example, on a level surface while FIG. 20 depicts a scenario in which a vehicle employing the sump feature is parked for example, on a non-level surface. The sump feature is particularly advantageous for more than one reason. In a first instance, the fuel filter 48 remains primed when the engine is off since the fuel level in the sump 68 continues to provide a fuel link into the filter 48. When the filter 48 is continuously subjected to liquid fuel, the filter 48 is able to undergo less prime time when the engine 12 is restarted. When less time is necessary to prime the fuel system, there is decreased probability that the engine 12 will be starved for fuel during the restarting process. This helps to ensure that the engine 12 and fuel system 19 will always have an adequate supply of fuel. The nozzle 71 (FIG. 18) protrudes into the sump and ensures that fuel from the sump has a liquid path to the filter 48.

Figure 21:
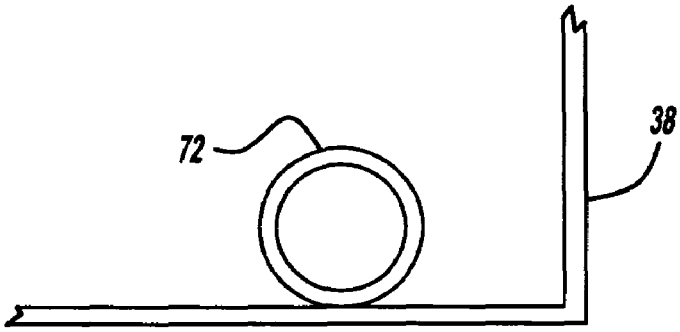
FIG. 21 is a top view of the sump area depicting its location relative to the reservoir wall in one embodiment.

A second advantage occurs when the fuel level in the reservoir 38 becomes lower than the sump wall 72. This situation may occur when an operator of the vehicle 10 fails to fill the tank 16 with fuel, thus creating a low fuel situation in the fuel tank 16 and reservoir 38. When the fuel level within the sump 68 is just below the sump wall 72 and the vehicle is then parked on a non-level surface, the fuel levels may be as depicted in FIG. 20. With respect to FIG. 20 as printed, the reservoir right corner 74 is starved for fuel while the left corner 75 has a disproportionate abundance of fuel. A sump configuration as depicted in FIG. 21, which is a top view of the reservoir floor, may create such a fuel level situation. Without the sump 68, no fuel would contact the nozzle 71 and subsequently reach the filter 48 in a low fuel situation. Fuel reaches the filter 48 from the sump 68 and through the nozzle 71 by capillary action. Without the sump 68, the sump orifice 66 of the nozzle 71 would be higher than the top surface of the fuel within the reservoir. However, with the sump 68, a liquid link to the filter 48 can be maintained because the sump retains fuel.

Although the nozzle 71 and sump orifice 66 perform the function of retaining fuel after the fuel pump 42 is turned off, the nozzle 71 and sump orifice 66 perform another function; the function is to increase the throughput of the fuel pump 42 to aid in cooling of the fuel pump 42 by additional liquid fuel passing through the pump 42. More specifically, the fuel pump 42 has a specific capacity for moving fuel through the pump if only the discharge tube 58 were present. However, by adding another outlet, in this case, the nozzle 71 and sump orifice 66, the volume of fuel through the fuel pump 42 is increased. Additional fuel passing through the fuel pump 42 provides additional cooling capacity to the fuel pump 42 via heat transfer from the fuel pump 42 to the liquid fuel. With fuel traveling in accordance with both arrows 62, 63, such additional cooling is provided. Such cooling may be necessary during low flow situations, such as when the engine 12 is in an idle condition or engine RPMs are otherwise low. The sump orifice 66 is also known as a bleed flow orifice.

FIG. 6 also depicts a jet pump tube 76 that is connected to a jet pump outlet 78 of the fuel pump 42. The jet pump tube line 76 passes through the reservoir 38 at the jet pump 80, within which a venturi effect is created to draw fuel from the fuel tank 16 into the reservoir 38 to maintain fuel in the reservoir 38 during low fuel levels in the tank 16. Fuel flows into the reservoir 38 in accordance with arrow 82 and is subsequently drawn through the fuel sock 43 in accordance with arrow 50. The fuel pump 42 supplies fuel to the jet pump tube 76 and subsequently, the jet pump 80 to create the venturi.

Figure 7:
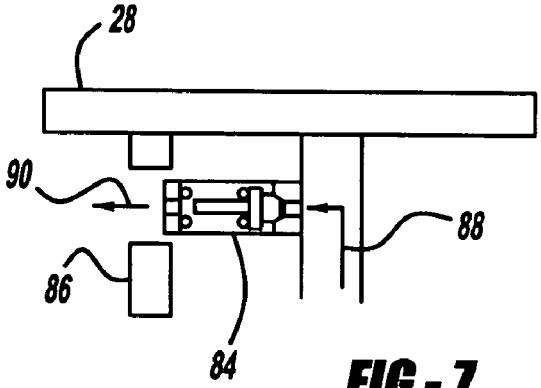
FIG. 7 is a side view of a pressure relief valve.

FIG. 7 is a side view of a pressure relief valve in accordance with the present invention. The pressure relief valve 84 is normally closed until the pressure in the discharge tube 58 becomes high enough to open the relief valve 84. When the pressure is high enough, fuel flows out through the relief valve 84 in accordance with flow lines 88, 90 and back into the fuel tank 16. In such a high pressure event, fuel never leaves the fuel tank 16. The relief valve 84 may be attached to the discharge tube 58 at the flange 28, and even to the flange wall 86.

Figure 8:
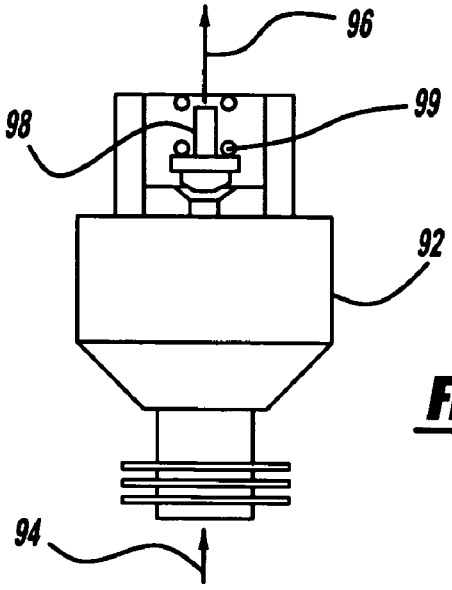
FIG. 8 is a side view of a pressure check valve.

FIG. 8 is a side view of a pressure check valve 92 in accordance with the present invention. The pressure check valve 92 is normally open when the fuel pump is running or "on" and only closes when the fuel pump is turned off, such is when the engine 12 is not running. When the check valve 92 is open, fuel flows in accordance with arrows 94, 96 and the check needle 98 lifts from its closed or shut position, which is down, in FIG. 8. By placing the relief valve 84 and the check valve 92 in the locations indicated in FIG. 6, the relief valve 84 and the check valve 92 can be easily installed or replaced since they are located outside of the reservoir 38 and under the flange 28, which is easily removed from the fuel tank 16.

Additionally, in this embodiment, the relief valve is set to open at a pressure slightly higher than the common rail pressure when the fuel pump is operating. By setting the relief valve 84 in this way, the common rail 24 and fuel line 14 is prevented from being damaged by higher than necessary fuel pressure; therefore, the relief valve opens and fuel is discharged into the fuel tank 16 when the pressure rises to a level that is higher than is necessary. Likewise, the relief valve 84 may open while the fuel pump 42 is not operating, such as during a "dead soak" period. A dead soak period typically occurs after an engine and fuel pump shut off, but while the fuel line is rising in temperature to the point where the pressure in the fuel line 14 is capable of rising above the highest recommended operating pressure. During such period of over pressurization, the valve 84 will open, causing fuel to flow from the fuel line 14 and discharge tube 58, and into the fuel tank 16. Dead soak is more likely to occur during the summer months when outdoor temperatures are higher, and thus, when combined with the heat from a normally operating engine, produce temperature levels that may cause fuel line pressure levels to become elevated.

With the valve arrangement of FIG. 6, the entire fuel line aft of the check valve 92 remains primed with fuel and pressurized at the desired engine operating fuel pressure when the engine and fuel pump are shut off, and hence the pressure check valve 92 closes. The advantage of this valve arrangement is that a large portion of the fuel supply system remains primed with fuel at the engine operating pressure. Thus, upon restarting the engine, the fuel pump 42 only has to spend a minimal amount of time priming the fuel system up to the check valve 92.

Figure 9:
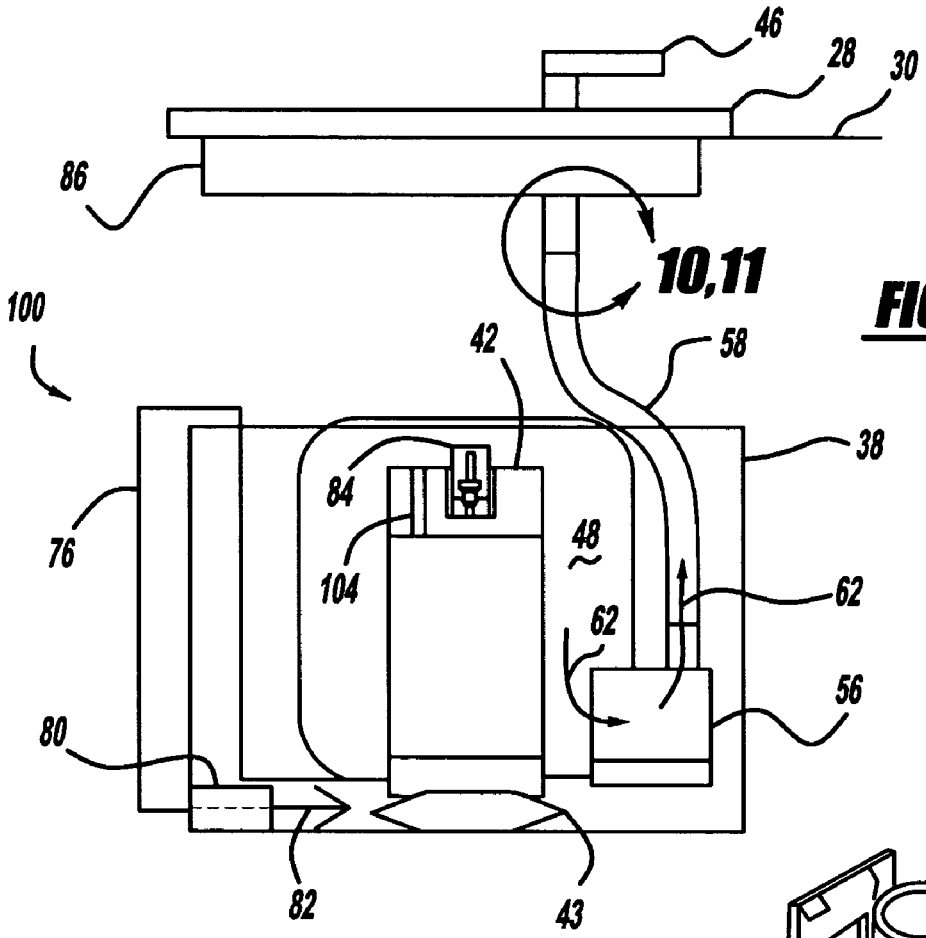
FIG. 9 is a side view of a fuel pump module depicting a pressure check valve and a bleed flow orifice.
Figure 10:
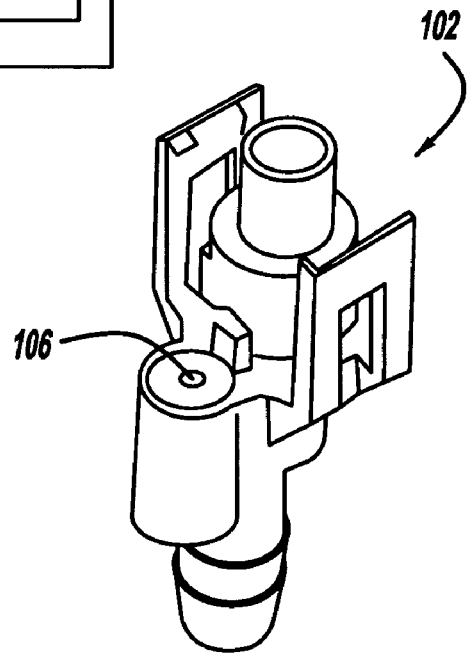
FIG. 10 is a perspective view of a one piece valve assembly housing a pressure relief valve.
Figure 11:
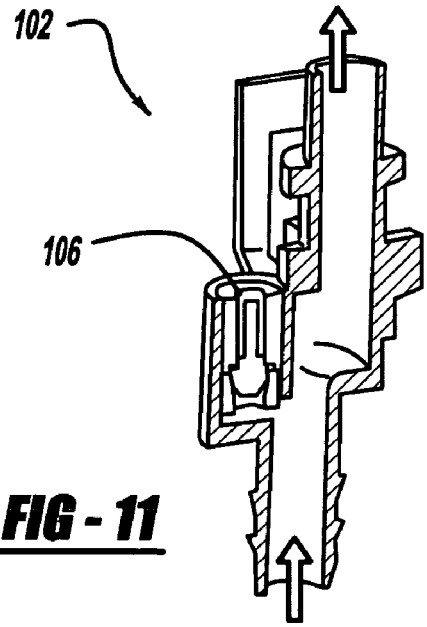
FIG. 11 is a cross-sectional view of the one piece valve assembly of FIG. 10 depicting a location of the relief valve within the valve assembly.

FIG. 9 is a side view of a fuel pump module 100 depicting a pressure check valve 84, a pressure relief valve 102 and a bleed flow orifice 104 in accordance with the present invention. FIG. 10 is a perspective view of a one piece valve assembly 102 housing a pressure relief valve in accordance with the present invention. FIG. 11 is a cross-sectional view of the one piece valve assembly of FIG. 10 depicting a location of the relief valve 102 within the valve assembly.

While a different pressure relief valve 102 is depicted in FIG. 9, from the embodiment in FIG. 6, the operative workings are the same. However, the pressure relief valve 102 of FIG. 9 has the advantage of being able to be quickly connected to the module flange 28 proximate the flange wall 86. Furthermore, the valve 102 also permits fuel to be discharged directly into the fuel tank 16 when the relief valve 102 opens, which is when the pressure in the fuel line 14 is slightly higher than the maximum recommended operating fuel line pressure. When the relief valve 102 opens when the fuel pump is operating, fuel discharges from opening 106.

The relief valve 102 of FIG. 9 may open while the fuel pump 42 is not operating, such as during a "dead soak" period. A dead soak period typically occurs after an engine and fuel pump shut off, but while the fuel line is rising in temperature to the point where the pressure in the fuel line 14 is capable of rising above the highest recommended operating pressure. During such period of over pressurization, the valve 102 will open, causing fuel to flow from the fuel line 14 and discharge tube 58, and into the fuel tank 16.

With continued reference to FIG. 9, the fuel pump module 100 will be further described. FIG. 9 differs from the embodiment of FIG. 6 in that FIG. 9 has a pressure check valve 84 on the fuel pump 42, and more specifically, at the top of the fuel pump 42. An advantage of having the pressure check valve 84 at the top of the fuel pump is that the entire fuel system aft of the pressure check valve 84 remains primed with fuel at an elevated pressure, typically the operating fuel pressure of the engine 12. Therefore, the fuel filter 48, fuel discharge housing 56, fuel discharge tube 58, and the entire fuel supply line 14 remain under pressure. The advantage of having the majority of the fuel system aft of the pressure check valve 84 of FIG. 9 is that when the engine is started, the fuel system will already be at operating pressure, and primed, and as such, the fuel pump 42 will immediately be able to supply fuel to the engine, and will not have to spend time pressurizing and filling with fuel, any part of the fuel system. The bleed flow orifice 104 discharges fuel into the reservoir 38 while the fuel pump 42 is operating. An advantage of this is the cooling that is provided to the fuel pump 42 by the extra fuel that is pumped through the fuel pump 42 and out of the bleed flow orifice 104. Since the heat transfer from the fuel pump 42 into the liquid fuel is increased as a result of additional fuel passing through the fuel pump 42, the fuel pump 42 undergoes cooling even at periods of low flow, such as at engine idle or low vehicle, and pump, speeds.

Figure 12:
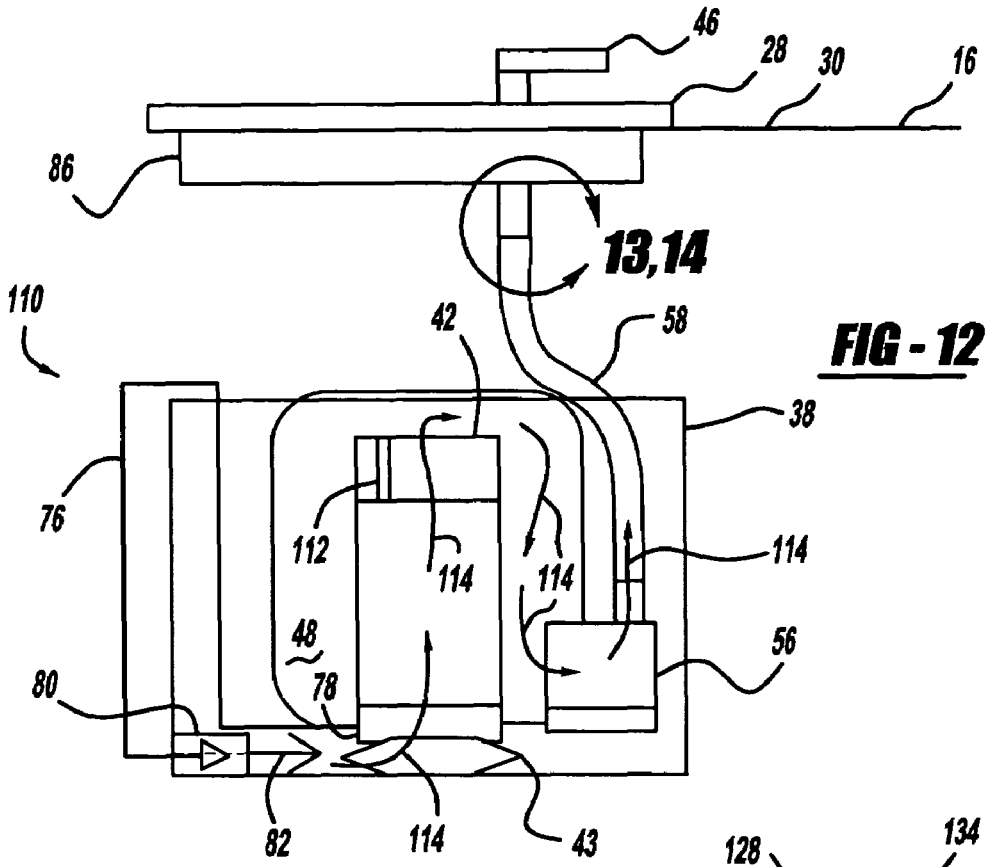
FIG. 12 is a side view of a fuel pump module depicting a bleed flow orifice.

FIG. 12 is a side view of a fuel pump module 110 depicting a bleed flow orifice 112 located at the top of the fuel pump 42 in accordance with an embodiment of the present invention. In the fuel pump module 110 according to this embodiment, a bleed flow orifice 112 is located near the top of the fuel pump 42 and discharges fuel into the reservoir 38 when the pump 42 is operating. The fuel pump 42 also draws fuel from the reservoir 38 in accordance with the fuel path 114. That is, fuel from inside the reservoir 38 passes through the fuel sock 43 and is drawn into and through the fuel pump 42. The fuel then passes into the filter 48 surrounding the fuel pump 42 and passes through the fuel discharge housing 56 and into the discharge tube 58. At the end of the discharge tube 58, the fuel passes into a valve 120 as depicted in enlarged views in FIG. 13 and FIG. 14. The valve 120 is actually a dual valve and houses a pressure relief valve 122 and a pressure check valve 124. These valves function in the same way as the like valves of the prior embodiments.

Figure 14:
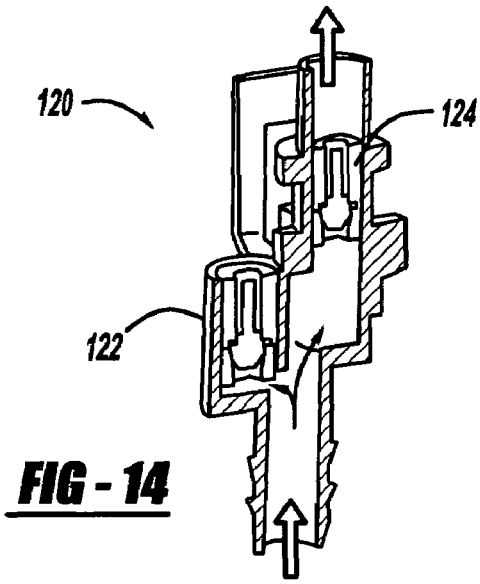
FIG. 14 is a cross-sectional view of the one piece valve assembly of FIG. 13 depicting a location of the pressure relief valve and the pressure check valve.
Figure 13:
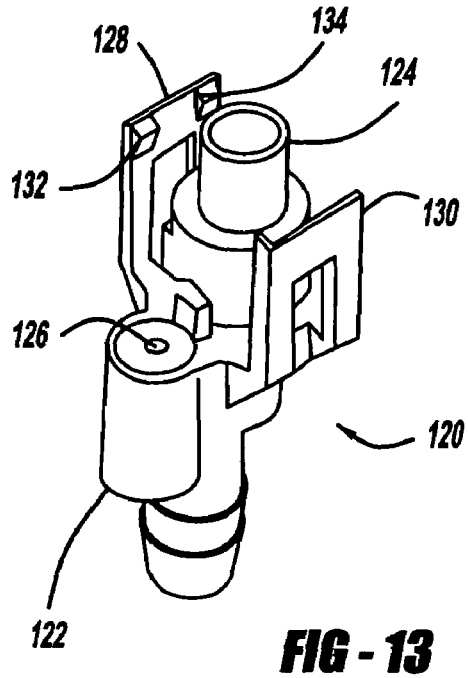
FIG. 13 is a perspective view of a one piece valve assembly housing a pressure relief valve and a pressure check valve.

FIGS. 13 and 14 depict the dual valve 120 with its pressure relief valve 122 and pressure check valve 124. The pressure relief valve 122 is normally closed, but set to open when the pressure at the valve exceeds the maximum recommended operating pressure of the fuel system. When the relief valve 122 opens, fuel is discharged into the fuel tank 16 through valve outlet 126 and the pressure in the fuel system is relieved and prevented from rising any further. The pressure check valve 124 is open and permits fuel to pass when the engine is on and the fuel pump is operating; however, the pressure check valve 124 closes as soon as the engine is turned off and the fuel pump 42 stops operating. The advantage of having the check valve close is that fuel in the fuel line 14 from the check valve 124 to the engine 12 remains at operating pressure. A further advantage is that when the engine is started again, the fuel pump 42 only has to re-prime the fuel system up to the check valve 124. In this way, the engine undergoes a lower probability of being starved for fuel during engine restarting. That is, the fewer the number of parts, that is, the lower the liquid volume, of the fuel system that needs to be primed during starting, the less likely the engine will be starved for fuel either during starting or shortly thereafter.

Continuing with FIG. 12, another advantage of the dual valve 120 is that it can be easily and quickly installed to the fuel pump module flange 28 because the valve 120 is equipped with clip tabs 128, 130 that have teeth 132, 134. Although not depicted, clip tab 130 has similar teeth to clip tab 128. Although the clip tabs 128, 130 are described with teeth 132, 134, any suitable fastening device may be used as long as the convenience and speed of fastening the valve 120 to the flange 28 or flange wall 86 is preserved.

FIG. 12 also depicts a jet pump 80 associated with the fuel pump module 110. Because the details of the jet pump 80 associated with this embodiment are the same as an above embodiment, further description will not be made here, although the reference numerals are depicted.

Figure 15:
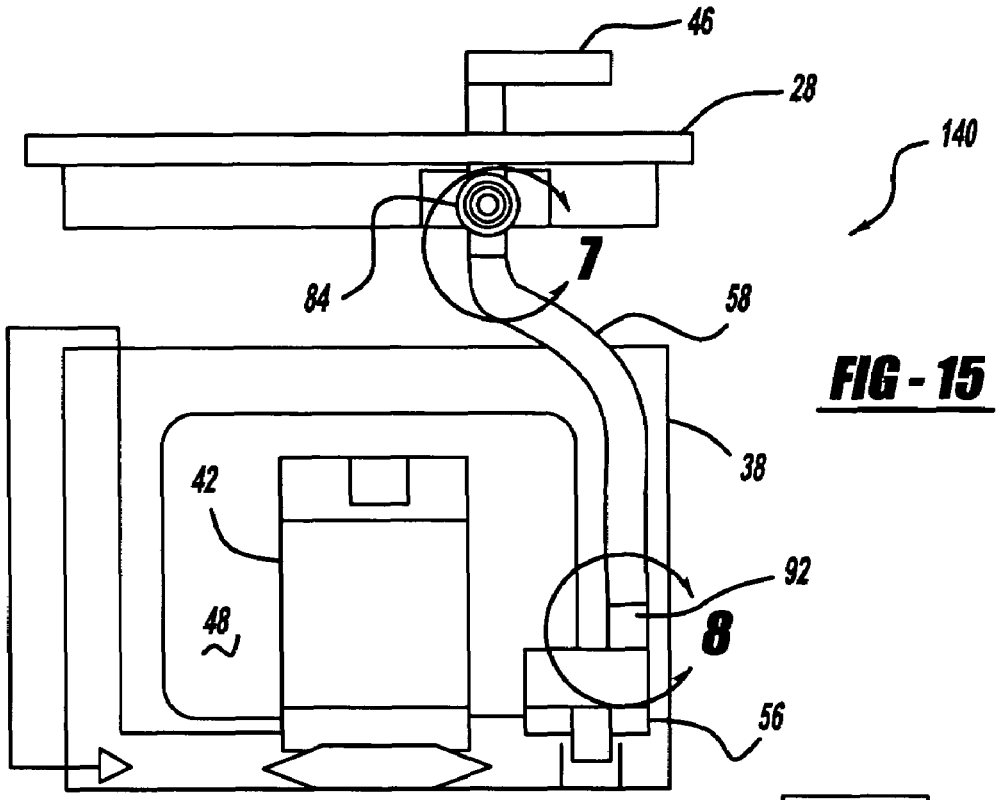
FIG. 15 is a side view of a fuel pump module.

FIG. 15 is a side view of a fuel pump module 140 in accordance with an embodiment of the teachings. The embodiment of FIG. 15 is similar to the embodiment depicted in FIG. 6, with one major difference. The difference is that the fuel pump module 140 of FIG. 15 depicts a pressure check valve 92 (FIG. 9) at a different location in the fuel system. More specifically, the pressure check valve 92 is located between the fuel discharge housing 56 and the pressure relief valve 84. In FIG. 15, the check valve 92 is located just aft of the fuel discharge housing 56. An advantage of locating the check valve 92 on the fuel discharge housing 56 is that when the valve 92 closes, which is when the engine 12 and fuel pump 42 are not operating, more fuel is contained in the fuel system at an elevated pressure. More specifically, an advantage is that upon restarting the engine 12, the fuel pump 42 has to prime less of the fuel system than if the check valve 92 was located farther downstream of the fuel pump 42.

As stated earlier, for the purposes of explaining the priming of the fuel system, the "fuel system" is every component from, and including, the fuel pump 42 to the fuel injectors 22; that is, the fuel pump 42, fuel filter 48, fuel discharge housing 56, pressure check valve 92, discharge tube 58, pressure relief valve 84, exit line 46, fuel line 14, injector rail 24, and injectors 22. Therefore, the closer the pressure check valve 92 is to the fuel pump 42, the fewer the components there will be in need of priming upon engine restarting. Another advantage of having the pressure check valve 92 at the fuel discharge housing 56 is its ease of installation and replacement because it is within the reservoir 38, which is easily assessed under the flange 28.

Figure 16:
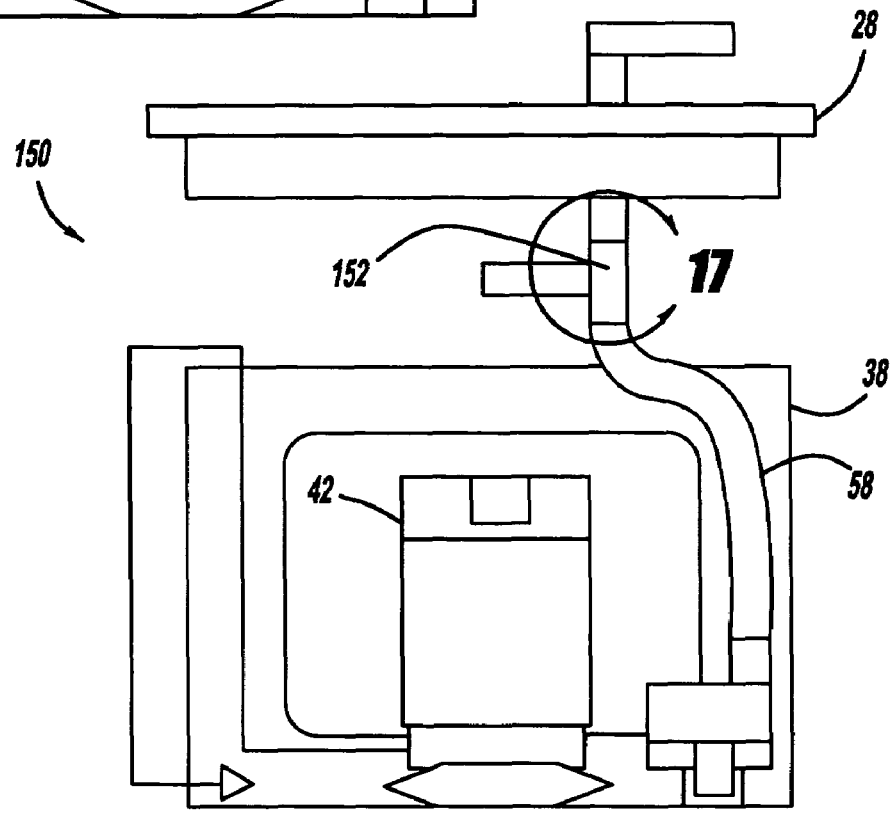
FIG. 16 is a side view of a fuel pump module utilizing in-line valves in a "T" arrangement.

FIG. 16 is a side view of a fuel pump module 150 in accordance with an embodiment of the present invention. The embodiment of FIG. 16 is similar to the embodiment depicted in FIG. 6, with one major difference. The difference is that the fuel pump module 150 of FIG. 16 depicts a combination valve 152, shown enlarged in FIG. 17, which consists of a pressure relief valve 154 and a pressure check valve 156 placed as in-line valves within the discharge tube 58. The pressure relief valve 154 performs the function of relieving the discharge tube 58, and hence, the fuel system, of pressure that is in excess of the maximum recommended fuel line pressure. When activated, the pressure relief valve 154 discharges fuel into the fuel tank 16, within which the module 150 resides.

Figure 17:
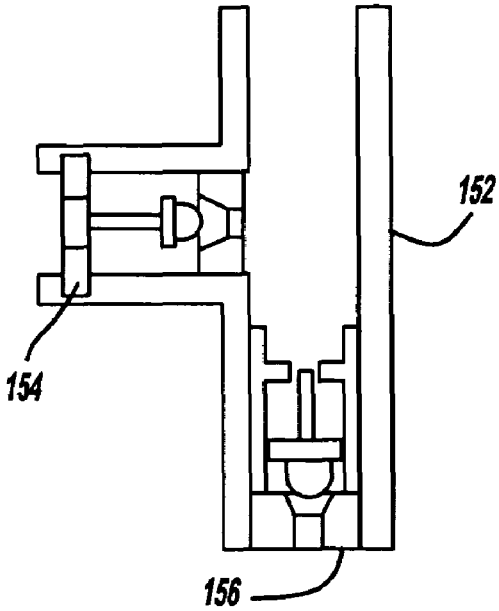
FIG. 17 is a cross-sectional view of a T-connector depicting an internal pressure relief valve and an internal pressure check valve.

The pressure check valve 156 of FIG. 17 is normally open when the fuel pump 42 is operating with the engine running. When the engine and fuel pump are stopped, the pressure check valve 156 closes and preserves the fuel and pressure in the fuel system, from the check valve 156 to the engine 14. An advantage of having the valves in a "T" device just under the flange 28 is that the valve 152 can be easily installed and accessed for replacement. Another advantage is that by locating the valve 152 close to the fuel pump 42, as much fuel and pressure can be preserved in the fuel system as possible which lessens the amount of time that the fuel pump requires to prime the fuel system upon engine starting. By lessening the time necessary for the pump 42 to prime the fuel system, the less likely the engine will be starved for fuel during restarting. Stated another way, an advantage is that upon restarting the engine 12, the fuel pump 42 has to prime less of the fuel system than if the check valve 156 is located farther downstream from the fuel pump 42.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump module comprising:
a fuel pump module reservoir;
a fuel pump located within said reservoir;
a fuel pump fuel outlet;
a fuel filter for filtering fuel from said fuel pump fuel outlet; and
a fuel discharge housing attached adjacent said fuel filter, said fuel discharge housing further comprising:
a housing fuel outlet for delivering fuel to an engine;
a housing fuel bleed orifice for delivering fuel to said reservoir; and
a sump integrally formed into said reservoir, said sump for directly receiving and retaining fuel from said housing fuel bleed orifice, wherein said housing fuel bleed orifice protrudes lower than a top surface of said sump and into a volume of said sump and maintains a continuous fuel link with fuel in said sump to maintain a prime condition of said filter.

2. The fuel pump module of claim 1, further comprising:
a fuel pump module flange; and
a fuel conduit located between said housing fuel outlet and said fuel pump module flange.

3. A fuel pump module comprising:
a fuel pump module reservoir;
a fuel pump located within said reservoir, said fuel pump having a fuel outlet;
a fuel filter surrounding said fuel pump that receives fuel from said fuel pump fuel outlet;
a fuel discharge housing attached adjacent said fuel filter and having a housing fuel bleed orifice directed toward a reservoir bottom; and
a sump integrally formed into said reservoir, said sump for receiving fuel directly from said housing fuel bleed orifice and maintaining a liquid fuel link between said sump and said fuel filter, wherein said housing fuel bleed orifice protrudes lower than a top surface of said sump and into a volume of said sump.

4. The fuel pump module of claim 3, further comprising:
a fuel pump module flange;
a housing fuel outlet, said housing fuel outlet for discharging fuel to said fuel pump module flange; and
a fuel conduit located between said housing fuel outlet and said fuel pump module flange.

5. The fuel pump module of claim 4, further comprising:
a fuel tank within which the fuel pump module resides;
a pressure relief valve located in said fuel conduit, said pressure relief valve for discharging pressure and fuel into the fuel tank.

6. A fuel pump module comprising:
a reservoir;
a fuel pump located within said reservoir;
a fuel filter that receives fuel from said fuel pump;
a fuel discharge housing attached adjacent said fuel filter, said fuel discharge housing further comprising:
a housing fuel outlet; and
a downwardly directed housing fuel bleed orifice;
a sump, said sump for receiving fuel from said housing fuel bleed orifice, wherein said downwardly directed housing fuel bleed orifice protrudes below a top surface of said sump and into a volume of said sump to maintain a prime condition of said fuel filter;
a fuel pump module flange; and
a fuel conduit, said fuel conduit located between said fuel discharge housing and said flange.

7. The fuel pump module of claim 6, further comprising:
a pressure relief valve, said pressure relief valve located in said flange.

8. The fuel pump module of claim 6, further comprising:
a pressure check valve; and
a pressure relief valve.

9. The fuel pump module of claim 8, wherein said pressure check valve is located at said housing fuel outlet.

10. The fuel pump module of claim 9, wherein:
said check valve opens when said fuel pump is pumping fuel and closes when said fuel pump is not pumping fuel.

11. The fuel pump module of claim 8, wherein said pressure relief valve attaches to said fuel pump module flange and said pressure check valve is located in said conduit.

12. The fuel pump module of claim 8, wherein said check valve is located on said fuel pump.

13. The fuel pump module of claim 8, wherein said pressure relief valve is located in said conduit.

* * * * *